US005718648A

United States Patent [19]

La Savio

[11] Patent Number: 5,718,648

[45] Date of Patent: *Feb. 17, 1998

[54] HOCKEY PUCK FOR STREET OR COURT

[76] Inventor: Michael La Savio, 4506 Ellenwood Dr., Eagle Rock, Calif. 90041

[ * ] Notice: The term of this patent shall not extend beyond the expiration date of Pat. No. 5,465,966.

[21] Appl. No.: 522,971

[22] Filed: Aug. 31, 1995

Related U.S. Application Data

[63] Continuation-in-part of Ser. No. 104,180, Aug. 9, 1993, Pat. No. 5,465,966.

[51] Int. Cl.[6] ..... A63B 71/00

[52] U.S. Cl. ..... 473/588

[58] Field of Search ..... 273/128 R, 128 CS, 273/128 A; 473/588, 589, 587

[56] References Cited

U.S. PATENT DOCUMENTS

| | | | |
|---|---|---|---|
| 3,997,164 | 12/1976 | White, Sr. | 273/128 R |
| 4,078,801 | 3/1978 | White, Sr. | 273/128 R |
| 4,111,419 | 9/1978 | Pellegrino | 273/128 A X |
| 4,153,253 | 5/1979 | White, Sr. | 273/128 R |
| 5,275,410 | 1/1994 | Bellehumeur et al. | 273/128 |
| 5,284,343 | 2/1994 | Bigornia et al. | 273/128 R |
| 5,465,966 | 11/1995 | La Savio | 273/128 R |

FOREIGN PATENT DOCUMENTS

| | | | |
|---|---|---|---|
| 820106 | 11/1951 | Germany | 273/128 CS |
| 2506181 | 8/1976 | Germany | 273/128 CS |

*Primary Examiner*—Raleigh W. Chiu
*Attorney, Agent, or Firm*—Wagner & Middlebrook

[57] ABSTRACT

An improved hockey puck particularly for street or court play has a cylindrical body and includes on each of its pair of planar faces three or more pistons or deflectable members attached to the puck body and extending above the face surfaces and acting as the sliding surfaces for the puck. Vertical forces applied to this puck are absorbed by springs or other resilient members supporting the pistons allowing the puck to slide with a minimized tendency to roll. In another embodiment, a plurality of resiliently mounted balls absorb vertical forces.

8 Claims, 4 Drawing Sheets

FIG. 1
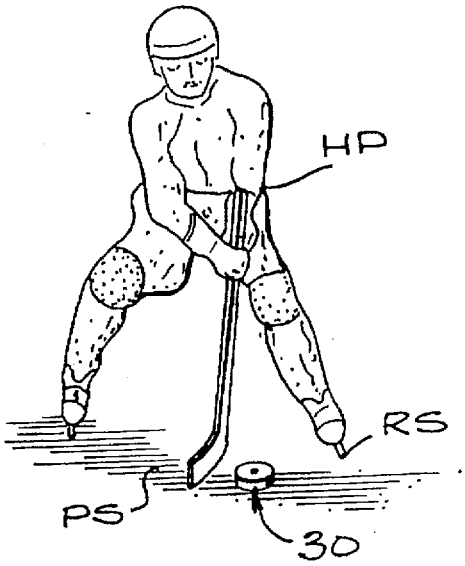
FIG. 2
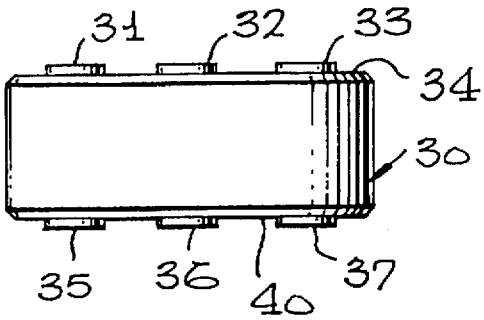
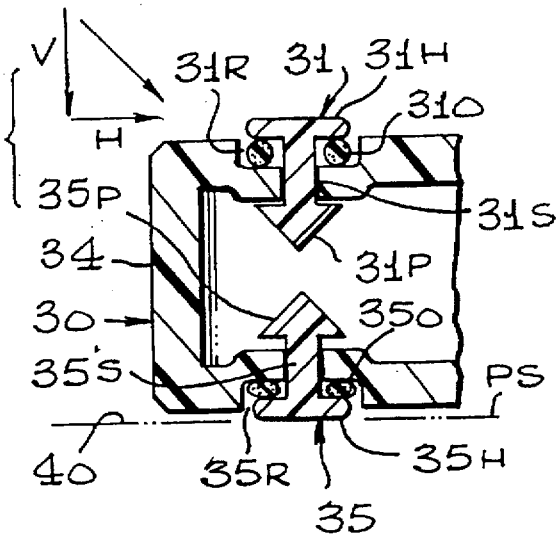
FIG. 3
FIG. 4
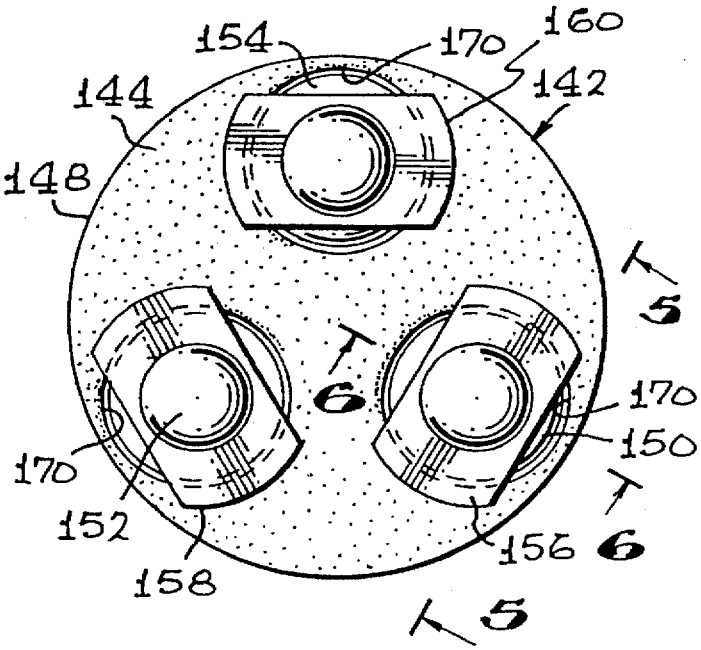

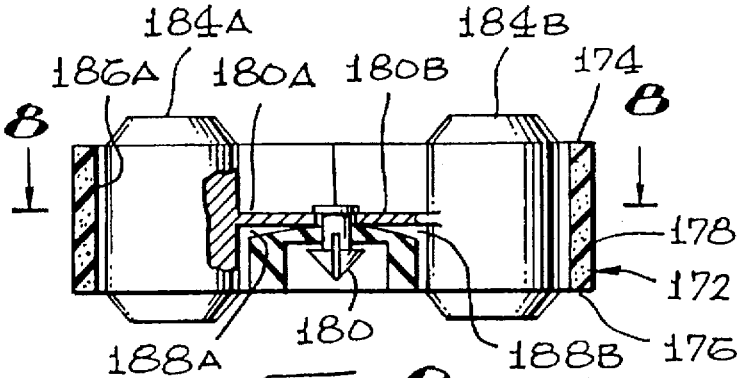
FIG. 9
FIG. 10
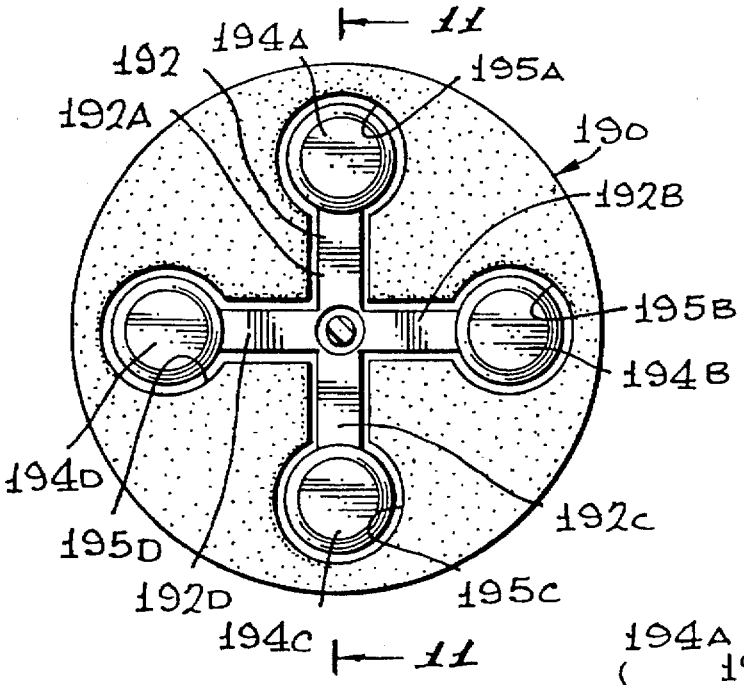
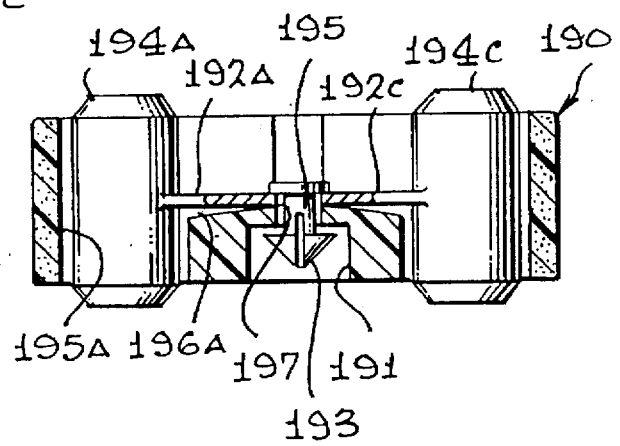
FIG. 11

FIG. 12
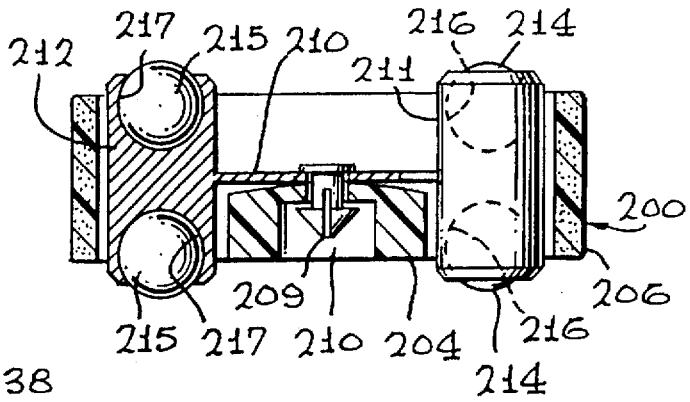
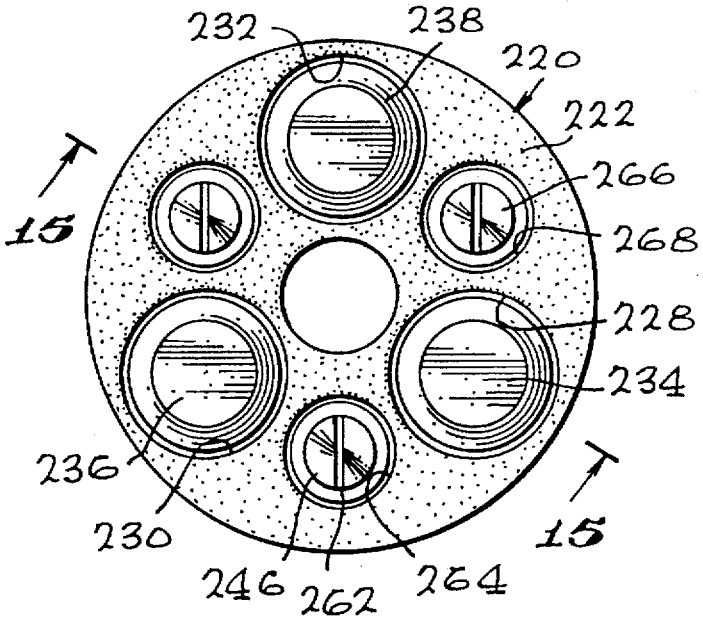
FIG. 13
FIG. 14
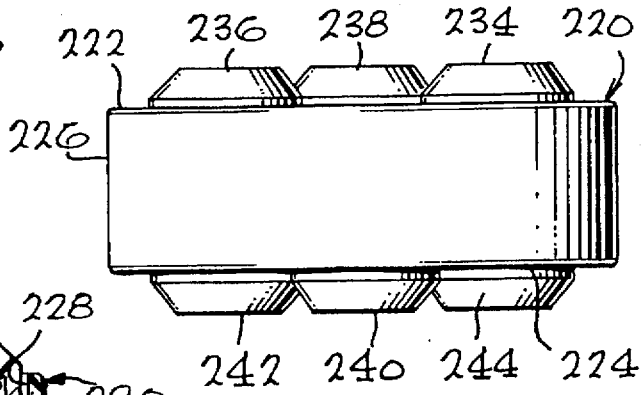
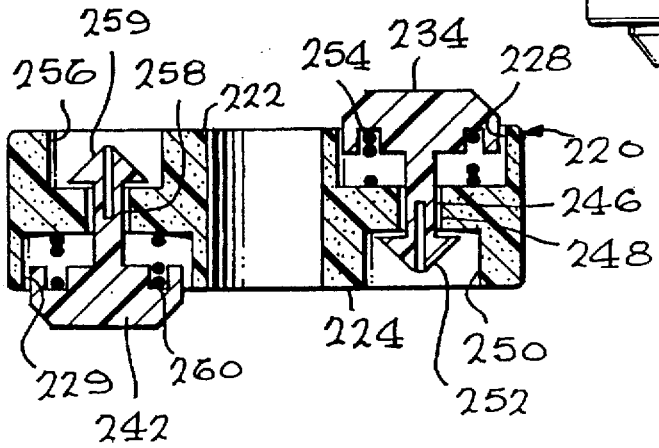
FIG. 15

HOCKEY PUCK FOR STREET OR COURT

REFERENCE TO RELATED APPLICATION

This application is a continuation-in-part of patent application Ser. No. 08/104,180 filed Aug. 9, 1993, now U.S. Pat. No. 5,465,966.

BACKGROUND OF THE INVENTION

In recent years the sport of hockey has expanded tremendously when adapted to year round play on streets or outdoor or indoor courts wherein the players wear roller skates. The skates worn are either of the conventional two truck side by side skates or the more recently popular in-line wheeled skates. In particular, the in-line wheeled skates provide action for the skater similar to ice skates and it is believed that this similarity has given rise to adaptation of ice hockey to street hockey with conventional sticks and a similar shaped hockey puck to the ice hockey puck. There are a few significant differences between the ice hockey puck and the street or court puck. The ice hockey puck is a cylinder normally made of a solid piece of rubber-like material weighing in the order of 6 ounces. In use, the ice hockey puck glides across the very slippery surface of a ice rink. With a powerful blow by a skilled player, the ice hockey puck can easily travel the entire length of an ice rink because of the low friction surface on which it rides.

The street or court hockey puck, however, slides on a surface which is distinctly less slick and can encounter pebbles or other discontinuities which interfere with distance and smooth travel. Street hockey pucks are significantly lighter in weight than ice hockey pucks, an example, 3½ ounces. As a regular street hockey player, I have been less than satisfied with existing rigid pucks. If the puck has a flat surface, even though it is light, the frictional engagement is such that the travel of the puck is limited. If it has sharp edges and a flat surface, there is a tendency for the puck to up-end and roll in an unruly and irksome fashion, causing poor puck behavior and general player consternation. If it has low friction rigid "feet" engagement with surface, discontinuities often cause up ending and random rolling. If the edges are curved to minimize the interference with obstructions or defects in the playing surface, the tendency to up-end and roll may be even greater. Various attempts have been made to improve street hockey pucks as are typified by the following patents:

| | | |
|---|---|---|
| 4,754,973 | Kunick, P. | July 5, 1988 |
| 4,793,769 | Dolan, M. | December 27, 1988 |
| 4,878,668 | Nevorol, V. | November 7, 1989 |
| 5,275,410 | Bellehumeur et al. | January 4, 1994 |

BRIEF DESCRIPTION OF THE INVENTION

I have approached the problem of excess friction and the problem of the tendency of street hockey pucks to roll. As a result, I have produced a number of versions of street or court hockey pucks which provide improved play, minimizing friction and minimizing the tendency to roll.

In some embodiments the puck includes on each face a plurality, for example three, button like projections, each of which have a resilient member beneath the buttons. The buttons present a low friction surface on which the puck rests and the resilient members can absorb any vertical component of travel by compression, minimizing the tendency to have the puck tip on end and roll. Also, the buttons may act independently of one another adding to stability of the puck.

In another embodiment a plurality (usually three) of ball bearings are captured in resilient mountings and spaced equivalent from each other and as close as practical to the outside edge of the puck body. The balls, in conjunction with resilient suspension members, provide a low friction contact with the court or street.

In additional embodiments, I have incorporated an internal spider-like member having radially extending flexible arms to which are attached cylindrical contact members movable in bores. As the cylindrical members strike the street or court, they deflect as permitted by the resilient arms of the spider-like members thereby absorbing a substantial part of the vertical force upon impact. This reduces the possibility of the puck up-ending and rolling on its cylindrical sidewall. Embodiments incorporating such spider-like members are disclosed having either three or four such radially extending arms.

A modification of the above embodiments incorporates captured balls in the end surfaces of the cylindrical members to further reduce the friction upon impact of the puck with the court or street.

BRIEF DESCRIPTION OF THE DRAWING

This invention may be more clearly understood from the following detailed description and by reference to the drawing in which:

FIG. 1 is a perspective view of a street or court hockey player employing the puck of this invention;

FIG. 2 is a side elevational view of a first embodiment of this invention;

FIG. 3 is a fragmentary enlarged sectional view through an edge region of the embodiment of FIG. 2 showing one pair of the support button members;

FIG. 4 is a top plan view of the second embodiment of this invention;

FIG. 9 is a vertical sectional view taken along line 9—9 of FIG. 8;

FIG. 10 is a top plan view of a fourth embodiment of this invention;

FIG. 11 is a diametrical vertical sectional view taken along line 11—11 of FIG. 10;

FIG. 12 is a vertical sectional view taken along line 11—11 of FIG. 10 showing a modified embodiment of the puck of FIGS. 10 and 11;

FIG. 13 is a top plan view of a fifth embodiment of this invention;

FIG. 14 is a side elevation of the puck of FIG. 13; and

FIG. 15 is a sectional view taken along line 15—15 of FIG. 13.

DETAILED DESCRIPTION OF THE INVENTION

Figure 5:
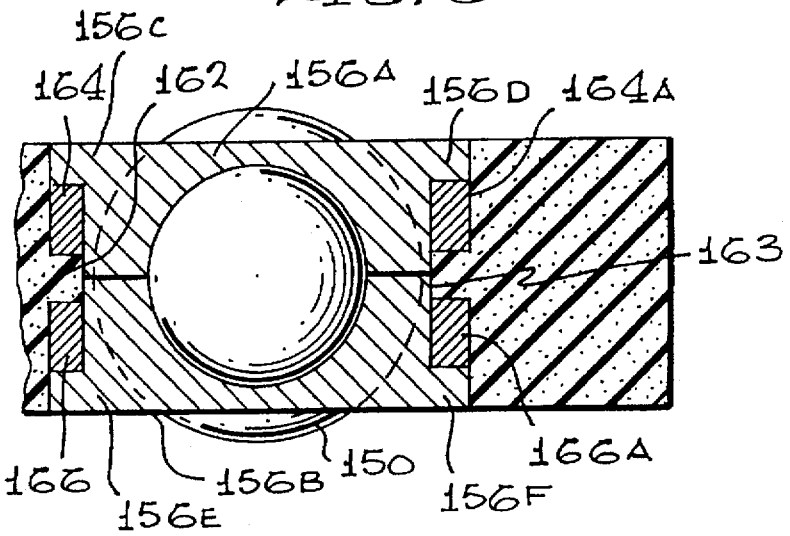
FIG. 5 is a vertical sectional view on an enlarged scale of part of the embodiment of FIG. 4 taken along line 5—5 of FIG. 4.

FIG. 1 shows a hockey player HP wearing a pair of in-line roller skates RS with a conventional hockey stick S employing a puck generally designated 30 incorporating the invention.

An embodiment of this invention illustrated in FIGS. 2 and 3 has certain advantages of simplicity of manufacture and eliminates any metal parts as well as allowing each button to behave independently of the others. In the case of the puck, generally designated 30, of FIGS. 2 and 3, there are a plurality of buttons, for example, three, 31, 32, and 33 in one planar surface 34 and an additional number of buttons 35, 36 and 37 in the opposite planar surface 40 of the puck 30. These buttons each rest in a respective recess of which recesses 31R and 35R are shown in FIG. 3. The buttons 31–37 are similar to certain upholstery buttons in that they have a head, a shank, and a point. In the drawing FIG. 3, these components for button 31 (31H, 31S and 31P) and 35 (35H, 35S, 35P) are illustrated and the comparable parts of buttons 32–34 and 36 and 37 do not appear in the drawing but are identical in structure to those showing in FIG. 3 for buttons 31 and 35.

Positioned beneath the head of each button is a resilient member, preferably in the form of an O-ring, O-rings 31 O and 35 O being shown in FIG. 3. As also shown in FIG. 3, the O-ring 35 O is shown compressed as the puck 30 is subject to a vertical component V as indicated by the downward arrow while the O-ring 31 O remains uncompressed. The O-rings are selected with a shore hardness in the order of 25–55 on the OO shore scale in order to provide sufficient resilience. The size of the heads such as 31 H and 35 H is sufficient that with full compression they still remain above the surfaces 34 or 40 and the heads only have frictional contact with the playing surface PS. This minimizes frictional contact between the playing surface PS and the puck 3O. A suitable material with good mechanical strength for the buttons 31–37 is nylon. Preferred is nylon 6—6 with a molybdenum disulfide filler.

Figure 6:
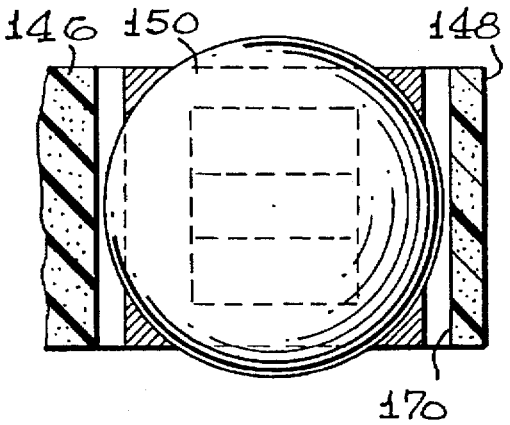
FIG. 6 is an enlarged sectional view taken along line 6—6 of FIG. 4.
Figure 7:
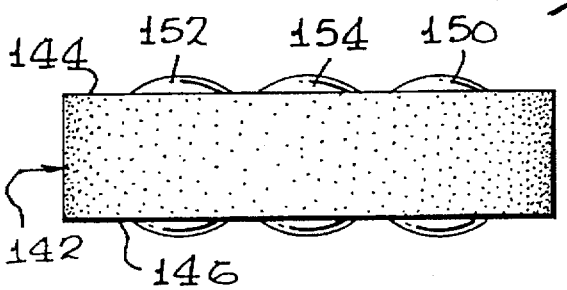
FIG. 7 is a side elevational view of the puck of FIGS. 4, 5, and 6.

An additional embodiment of my invention is shown in FIGS. 4, 5, 6 and 7 wherein FIG. 4 is a top plan view of the embodiment, FIG. 5 is a sectional view taken along line 5—5 of FIG. 4, FIG. 6 is a sectional view taken along line 6—6 of FIG. 4, and FIG. 7 is a side elevational view of the puck of FIGS. 4, 5 and 6. The puck 142 has generally planar opposite surfaces 144 and 146 and a cylindrical sidewall 148. A plurality of spherical bearings 150, 152 and 154 are carried in puck 142 by means of corresponding bearing carriers 156, 158 and 160. Carrier 150 (FIG. 5) includes two mating parts 156A and 156B. Carriers 158 and 160 are identical to carrier 150. Inwardly extending flanges 162, 163 forming part of puck 142 provide part of the support for sets of arcuate cushion members 164, 164A and 166, 166A which may be of suitable resilient material such as rubber and which are captured between flanges 162, 163 and outwardly extending flanges 156C and 156D forming part of carrier member 156A and flanges 156E and 156F forming part of carrier member 156B. When carrier members 156A and 156B are fastened together by any suitable means such as cement, the arcuate cushion members 164, 164A, 166 and 166A are secured in position as shown.

From FIGS. 4, 5 and 6, it will be seen that bearing 150 is captured by carrier 156 but is enclosed to only a limited extent by members 156A and 156B. In addition to the parts of bearing 150 which extend above and below the puck 142, the cylindrical opening 170 provides additional clearance for ball bearing 150. Bearings 152 and 154 are captured by carriers 158 and 160 which are identical to carrier 156.

FIG. 7 is a side elevational view of the puck of FIGS. 4, 5 and 6. It will be observed that all three bearings 150, 152 and 154 extend out of or beyond the surfaces 144 and 146 of the puck such that they will tend to compress the arcuate cushion members, making puck 142B less likely to be deflected from an initial course. Puck 142 is also less likely to be up-ended and roll on its cylindrical edge. With the three bearings working smoothly in their carriers puck 142 has less resistance to moving across a court or street than most pucks made for this purpose.

Figure 8:
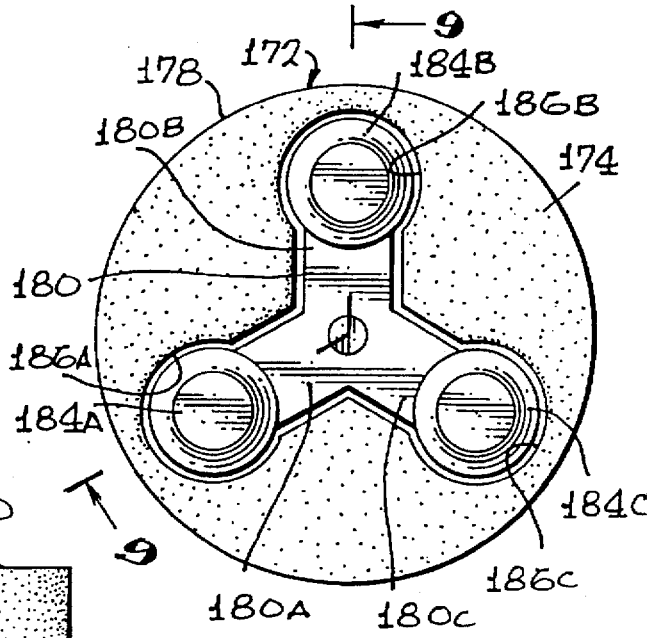
FIG. 8 is a top plan view of a third embodiment of this invention.

An additional embodiment of my invention is shown in FIGS. 8 and 9 wherein FIG. 8 is a top plan view of the embodiment and FIG. 9 is a sectional drawing taken along line 9—9 of FIG. 8. The puck 172 includes opposite planar surfaces 174 and 176 and a cylindrical sidewall 178. Secured in the interior of puck 172 is a spider-like member 180 having three radially extending resilient arms 180A, 180B and 180C. At the end of the arms are cylindrical members 184A, 184B and 184C which are positioned in respective bores 186A, 186B and 186C. Arms 180A, 180B and 180C are flexible (springy) and will deflect within the spaces in puck 172 of which spaces 188A and 188B are shown in FIG. 9. An identical space is provided to permit deflection of arm 180C. When puck 172 strikes a hard surface such as a street, the cylindrical members 184A, 184B and 184C are caused to deflect an amount permitted by movement of arms 180A, 180B and 180C. This absorbs a substantial part of the vertical component V referred to above and minimizes the chances of the puck 172 becoming up-ended and rolling on its cylindrical surface 178. Since both sides are nearly identical, the puck will behave the same irrespective of which side contacts the street.

FIGS. 10 and 11 depict a modification of the puck 172. FIG. 10 is a top plan view of this embodiment and FIG. 11 is a sectional view taken along line 11—11 of FIG. 10. In this embodiment, the spider member 192 of puck 190 has four arms 192A, 192B, 192C and 192D having cylindrical members 194A, 194B, 194C and 194D fastened to their outboard ends. Cylindrical members 194A, 194B, 194C and 194D are movable in bores 195A, 195B, 195C and 195D. Internally of puck 190 are spaces of which spaces 196A and 196C are shown in FIG. 11. These spaces permit deflection of the arms 198A, 192B, 192C and 192D when their corresponding cylindrical members strike the street or court surface as set forth above. FIG. 11 also shows a well 191 in puck 190 receiving a slotted point 193 attached to a shank 195. Shank 195 passes through a passage 197 to secure spider member 192 to puck 190.

A further modification of the puck 172 is shown in FIG. 12 wherein FIG. 12 is a sectional drawing similar to FIG. 11. This puck 200 includes planar surfaces 202 and 204 and a cylindrical sidewall 206. It includes a spider-like member 210 secured to its interior which may be identical to either of members 180 or 192 and may have either 3 or 4 arms. Member 210 is secured to puck 200 by means of a slotted shank and point 209 in the same manner that member 192 is attached to puck 190. Members 211 and 212 are deflected in the same manner as cylindrical members 180A, 180B and 180C. Captured in the ends of cylindrical members 211 and 212 are a plurality of balls 214 and 215 rotatable in sockets 216 and 217 respectively. Similar cylindrical members, balls and sockets are attached to other arms of member 210. These balls further reduce the friction upon contact of the puck with the street and thereby further minimize the possibility of the puck 200 becoming up-ended and rolling on its cylindrical sidewall 206.

A still further embodiment of my invention appears in FIGS. 13, 14 and 15 where FIG. 13 is a top plan view; FIG. 14 is a side elevational view; and FIG. 15 is a sectional view taken along line 15—15 of FIG. 13. This puck 220 also has two planar surfaces 222 and 224 and a cylindrical sidewall 226. Surface 222 includes a plurality (in this case, three) of relatively large cylindrical recesses 228, 230 and 232, carrying shallow pistons 234, 236 and 238 respectively. Similarly, planar surface 224 includes cylindrical recesses carrying pistons 240, 242, and 244 of which only recess 229 is shown in FIG. 15. Piston 242 is movable in recess 229 as shown in FIG. 15. Piston 234 is similarly movable in recess 228 in planar surface 222.

From FIG. 14, it will be observed that, as seen from a side elevation, pistons 234 and 236 are forward of piston 238. On planar surface 224, piston 240 is forward and pistons 242 and 244 are behind piston 240. Thus the pistons are displaced 120 degrees on each face and 60 degrees from each other from top to bottom.

FIG. 15 shows that piston 234 is molded with a shank 246 having a point 252 with a slot which passes through a flange defining a narrow port 248 and then expands to capture piston 234. Point 252 is secured in a cylindrical well 250 opposite recess 228. Piston 234 is urged outwardly of recess 228 by means of a spring 254. Directly across puck 220 (180 degrees displaced) from piston 234 and well 250 are piston 242 in recess 229 and a well 256. Piston 242 is molded with a slotted shank 258 and a point 259 similar to shank 246 and is spring-loaded outwardly of planar surface 224 by means of a spring 260. Pistons 240 and 244 have identical slotted shanks 262 and 266 in wells 264 and 268 and pistons 240 and 244 are secured to wells 264 and 268 in the same manner as described in relation to piston 242. Pistons 236 and 238 are secured to puck 220 in the same manner as described relative to piston 234.

The operation of the embodiment of FIGS. 13, 14 and 15 is similar to that of FIGS. 2 and 3. When the puck is struck by a stick, it may slide along the pistons on one side or the other or it may fly for a distance, possibly coming down at an angle with the playing surface. Pistons 234, 236 and 238 protrude a significant distance from planar surface 222 and will move inwardly against the force of their respective springs if exposed to an angular force, thus absorbing all or much of the vertical component of such force. Even with fill deflection of the springs, portions of the pistons remain above the levels of the faces 222 and 224. Should the puck impact the playing field on the opposite side, all or part of the vertical component of the force will be absorbed by pistons 240, 242 or 244. Absorption of the vertical component of force tends to substantially inhibit the tendency for the puck to become up-ended and roll on its cylindrical surface.

The above described embodiments of the present invention are merely descriptive of its principles and are not to be considered limiting. The scope of the present invention instead shall be determined from the scope of the following claims including their equivalents.

What is claimed is:

1. A roll resistant hockey puck for use on a playing surface comprising a body having a cylindrical edge surface and a pair of generally planar faces;

a plurality of axially directed passages extending between said faces;

axially movable members in at least some of said passages; and mounting means securing said axially movable members to said body, said mounting means including resilient means permitting axial movement of said movable members relative to said body to allow absorption of energy from a blow having a component normal to said planar faces;

said axially movable members extending outwardly of said planar faces such that portions of said members remain above the levels of said generally planar faces even under full deflection of said resilient means.

2. A hockey puck as claimed in claim 1 wherein said axially movable members include pistons in said passages, said passages include inwardly directed flanges defining ports, and said axially movable members further include shafts connected to said pistons extending through said ports and larger diameter portions securing said axially movable members in said passages.

3. A hockey puck as claimed in claim 2 wherein said larger diameter portions are of flexible material containing cut-outs and barbed points permitting said larger diameter portions to pass through said ports and expand to lock said axially movable members within said passages.

4. A hockey puck as claimed in claim 2 wherein said resilient means are located between said pistons and said flanges.

5. A hockey puck as claimed in claim 1 wherein said axially movable members include pistons in said passages, said passages include inwardly extending flanges defining ports and said mounting means include shafts extending through said ports and larger diameter members secured to said shafts securing said pistons in said passages.

6. A hockey puck as claimed in claim 1 wherein said passages include cylindrical recesses, said axially movable members include pistons in said recesses, said passages further include inwardly extending flanges defining ports, said resilient means are located between said flanges and said pistons, and said mounting means include shafts connected to said pistons extending through said ports and larger diameter members secured to said shafts on the opposite side of said flanges from said pistons securing said pistons in said recesses.

7. A hockey puck as claimed in claim 6 wherein said resilient means are springs.

8. A hockey puck comprising a housing in the form of a cylinder having a central axis and a pair of faces for sliding contact with a playing surface, said housing including a plurality of axially directed passages and internally directed flanges defining ports in said passages, and cylindrical recesses in said passages;

a plurality of pistons secured in said cylindrical recesses for axial movement therein, mounting means including axially directed smaller diameter shafts attached to said pistons passing through said ports and larger diameter members on the opposite side of said ports from said pistons for securing said pistons in said cylindrical recesses; and resilient members between said pistons and said flanges.

* * * * *